US009469949B2

(12) United States Patent
Tonks et al.

(10) Patent No.: US 9,469,949 B2
(45) Date of Patent: Oct. 18, 2016

(54) ROAD SAFETY BARRIER

(71) Applicant: Hill & Smith Limited, Wolverhampton (GB)

(72) Inventors: Mark Tonks, Wolverhampton (GB); Matthew Harriman, Swadlincote (GB); Steve Wells, Yukon, OK (US)

(73) Assignee: Hill & Smith Limited, Wolverhampton (GB)

( * ) Notice: Subject to any disclaimer, the term of this patent is extended or adjusted under 35 U.S.C. 154(b) by 0 days.

(21) Appl. No.: 14/960,478

(22) Filed: Dec. 7, 2015

(65) Prior Publication Data

US 2016/0083917 A1 Mar. 24, 2016

Related U.S. Application Data

(63) Continuation of application No. 13/808,315, filed as application No. PCT/GB2011/000977 on Jun. 29, 2011, now Pat. No. 9,234,324.

(30) Foreign Application Priority Data

Jul. 5, 2010 (GB) ..... 1011265.4

(51) Int. Cl.
*E01F 15/06* (2006.01)
*E04H 17/12* (2006.01)
(Continued)

(52) U.S. Cl.
CPC ..... *E01F 15/06* (2013.01); *E04H 17/06* (2013.01); *E04H 17/08* (2013.01); *E04H 17/10* (2013.01); *E04H 17/12* (2013.01)

(58) Field of Classification Search
CPC ..... E01F 15/02; E01F 15/06; E04H 17/02; E04H 17/04; E04H 17/06; E04H 17/08; E04H 17/10; E04H 17/12; E04H 17/24
USPC ..... 256/13.1, 47, 48, 54, DIG. 3; 24/11 R, 24/457, 704.1
See application file for complete search history.

(56) References Cited

U.S. PATENT DOCUMENTS 371,122 A 10/1887 Bush
D913,402 2/1909 Knickerbocker
(Continued)

FOREIGN PATENT DOCUMENTS

AU 43026 78 10/1979
AU 2009248435 A1 1/2010
(Continued)

OTHER PUBLICATIONS

Examination Report from Chinese Patent Office dated Sep. 23, 2014 for corresponding Chinese Patent Application No. 103154374.
(Continued)

*Primary Examiner* — Josh Skroupa
(74) *Attorney, Agent, or Firm* — Rhodes Donahoe, LLC; Robert V. Donahoe

(57) ABSTRACT

A wire rope road safety barrier including at least one wire rope, a plurality of posts configured to be supported in the ground along a roadside or central reservation, the posts including a cut-out provided in respective ones of the posts, and a retainer. The retainer includes an arm for embracing at least half of a circumference of the post whereby the retainer can be held on the post at a position along its length, the arm defining a plane, and a tab extending perpendicularly from the plane of the arm for retaining the at least one wire rope against the post, the tab being configured to yield at a break point at which the tab is attached to the arm when subjected to a lateral force by the at least one wire rope that exceeds a predetermined amount to permit separation of the rope from the barrier within a predetermined impact zone.

16 Claims, 3 Drawing Sheets

(51) Int. Cl.

| | |
|---|---|
| ***E04H 17/06*** | (2006.01) |
| ***E04H 17/08*** | (2006.01) |
| ***E04H 17/10*** | (2006.01) |

(56) References Cited

U.S. PATENT DOCUMENTS

| | | | |
|---|---|---|---|
| 1,145,583 | A | 7/1915 | Heath et al. |
| 1,280,093 | A | 9/1918 | Sholund |
| 2,509,598 | A | 5/1950 | Hart |
| 2,677,530 | A | 5/1954 | Lauffenburger |
| 3,353,774 | A | 11/1967 | Albert |
| 5,518,056 | A | 5/1996 | Voss |
| 6,895,640 | B2 | 5/2005 | Odaka |
| 8,540,217 | B2 | 9/2013 | Olsson et al. |
| 2003/0222254 | A1 | 12/2003 | Bergendahl |
| 2010/0308292 | A1 | 12/2010 | Rawls |

FOREIGN PATENT DOCUMENTS

| | | | |
|---|---|---|---|
| CN | 2928942 | Y | 8/2007 |
| CN | 2937239 | Y | 8/2007 |
| CN | 200949216 | Y | 9/2007 |
| CN | 201459642 | U | 5/2010 |
| CN | 101806166 | A | 8/2010 |
| DE | 1784768 | | 11/1971 |
| DE | 32 48 438 | | 7/1984 |
| DE | 19848277 | C1 | 11/2000 |
| EP | 0292617 | A1 | 11/1988 |
| EP | 0428468 | A1 | 5/1991 |
| FR | 2816344 | | 5/2002 |
| GB | 2466878 | | 7/2010 |
| WO | 2007129914 | A1 | 11/2007 |

OTHER PUBLICATIONS

Examination Report dated Nov. 24, 2010 issued by the Intellectual Property Office of Great Britain in corresponding Great Britain Application No. 1011265.4.

Examination Report from Chilean Patent Office dated Nov. 3, 2014 for corresponding Chilean Patent Application No. 2013-000030.

Examination Report from IPO New Zealand dated Jan. 15, 2015 for corresponding New Zealand Patent Application No. 703711.

Examination Report from IPO New Zealand dated Jan. 15, 2015 for corresponding New Zealand Patent Application No. 703708.

International Search Report and Written Opinion in corresponding International Application No. PCT/GB2011/000977 (dated Apr. 11, 2011).

"Tensile Properties." NDT Resource Center. Aug. 15, 2007, [online], [retrieved on Jun. 17, 2015] Retrieved from the Internet <URL: https://web.archive.org/web/20070815161920/http://www.nde-ed.org/EducationResources/ Communitycollege/Materials/Mechanical/Tensile.htm>.

Search Report from Taiwanese Intellectual Property Office dated Apr. 18, 2016 for counterpart Taiwan Invention Patent Application No. 100123690.

ROAD SAFETY BARRIER

This invention relates to a road safety barrier having retainers for holding a wire rope or cable against a post or posts of the road safety barrier, and in particular but not exclusively to a retainer having a yieldable or frangible tab.

Conventional wire rope road safety barriers comprise a series of spaced apart posts that are provided with hooks or notches for supporting the wire rope which may weave sinuously around the posts or in parallel thereto. These road safety barriers typically consist of two or more ropes (normally two to five) along the side of the barrier and perhaps one or two ropes lying within slots positioned at the top of the posts. Wire rope safety barriers serve to deflect impacting vehicles back into the carriageway or to decelerate the impacting vehicle as it slides along the barrier. Posts within the impact zone tend to collapse on impact and as a consequence, the wire rope becomes detached from the posts. Conventional road safety barriers have the problem that the ropes on vehicle impact become detached from the barrier for a significant distance up and downstream of the impact area. The detachment arises as shock wave, sometimes referred to as 'whip', from the vehicle impact travels along the wire ropes of the barrier. Consequently, there is a significant degree of rope deflection or separation from this whip which leads to an unpredictable impact characteristic of the road safety barrier on vehicle impact. Over-deflection or separation of the ropes outside of the impact zone due to the whip reduces the effectiveness of the barrier's ability to restrain impacting vehicles. Moreover, the force of the whip itself can lead to unpredictable behaviour of the wire ropes on collapse which can compromise the ability of the barrier to restrain the vehicle.

It is an aim of the present invention to provide a retainer for holding a rope or cable against a post of a road safety barrier that serves to alleviate the aforementioned problem. In an alternative aspect, it is an aim of the present invention to provide a post for a road safety barrier that serves to improve the deflection characteristics of a wire rope on vehicle impact.

According to the present invention, there is provided a retainer for a wire rope road safety barrier comprising a plurality of posts for supporting one or more wire ropes above the ground, the retainer comprising an arm for embracing at least half of a circumference of the post whereby the retainer can be held on the post at a position along its length, and a frangible or yieldable tab extending from the arm for retaining the wire rope against the post.

In one embodiment, the arm may be in the form of a ring. In this case, the retainer can be placed over the post and slid along the longitudinal axis thereof into position such that the tab passes over the wire rope. Alternatively, the arm may be in the form of a split ring that can be positioned on the post from a transverse direction relative to the longitudinal axis of the post.

The frangible or yieldable tab is preferably configured to break or yield when subjected to a lateral force by the wire rope that exceeds a predetermined amount, thereby allowing the wire rope to deflect away from the post. The predetermined amount is inversely proportional to a lateral extent along the line of the road safety barrier of the impact zone that is subject to wire rope deflection. In other words, the force required to break or cause the tab to reach its yield point with respect to the arm is selected to resist separation of the wire rope from the road safety barrier posts such as to minimise the extent of the vehicle impact zone. It is therefore intended that the strength of the tab is greater than the force of the whip on vehicle impact, but not so strong that the tab will not break away from the arm in the region of contact between the impacting vehicle and the fence as the vehicle moves or slides along the road safety barrier.

In a preferred embodiment, the tab is configured to retain the wire rope snugly against the post. The tab may have a curved profile that corresponds to the curvature of the rope in order to provide a snug fit between the tab and the post.

According to the present invention, there is further provided a post for a wire rope road safety barrier comprising a cut-out for supporting the wire rope, wherein the cut-out is recessed within an outer periphery of the post and has a substantially flat portion that extends transversely to the longitudinal axis of the post and a curved portion extending from a part of the flat portion that is innermost relative to the outer periphery of the post to the outer periphery, wherein the substantially flat portion resists downward movement of the rope during vehicle impact whereas the curved portion permits upward movement thereof. This notch or cut-out profile also serves to provide a snug fit for the wire rope between the post and the tab. In this case, the tab bridges the notch to establish the snug fit of the wire rope between the tab, the curved and flat portions of the cut-out. The snug fit helps to secure the wire rope from moving as the shock wave (i.e. whip) arising from the vehicle impact is transmitted along the wire rope of the road safety barrier. The snug fit also assists in the transfer of the forces of the shock wave from the wire rope to the barrier post, thereby attenuating the distance of travel of the shock wave along the road safety barrier, which in turn, reduces the extent of separation of the wire rope from the posts.

According to the present invention, there is provided a wire rope road safety barrier comprising a plurality of posts as defined above supported in the ground along a roadside or a central reservation and at least one wire rope supported within a cut-out provided in respective ones of the posts, wherein the wire rope is retained captive within the cut-out by the tab of the retainer as defined above.

Embodiments of the present invention are advantageous in that they reduce the extent of separation of the wire rope from the road safety barrier posts outside the vehicle impact zone. Consequently, the integrity of the road safety barrier outside the immediate impact zone is maintained. The profile of the notch or cut-out is such as to resist downward movement of the wire rope but permit upward deflection of the wire rope outside the vehicle impact area. Embodiments of the present invention may include road safety barriers that have wire ropes woven sinuously about the posts or barriers having wire ropes that run parallel (i.e. non-woven) to the line of the barrier.

The invention will now be described by way of example, with reference to the accompanying drawings, in which.

Figure 1:
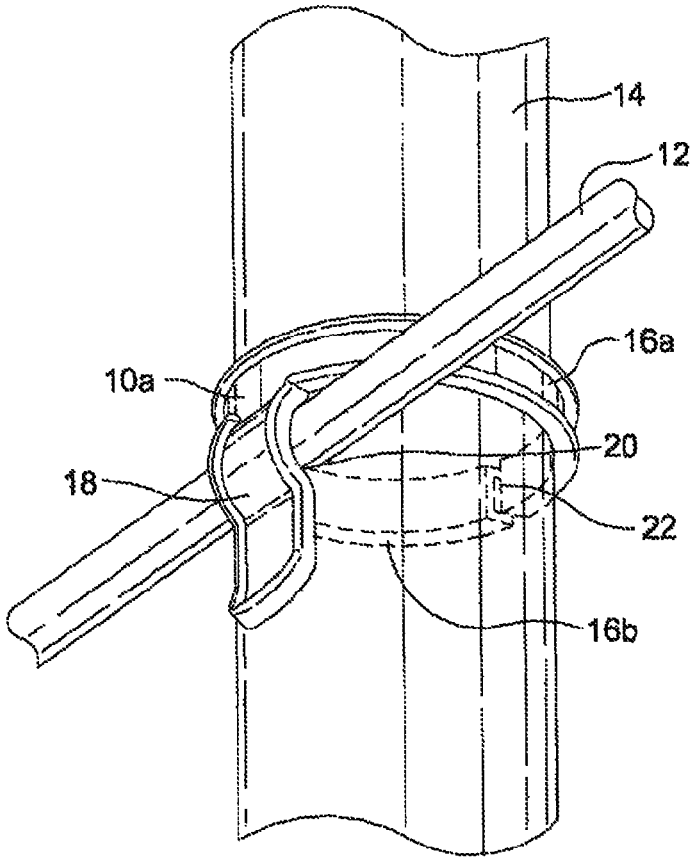
FIG. 1 is a schematic of a retainer embodying the present invention and is shown in use with a wire and a post according to another aspect of the present invention.

FIG. 1 shows a retainer 10*a*, intended for holding a wire rope 12 or cable against a post 14 of a road safety barrier.

The retainer 10*a* comprises at least one annular arm 16*a*, 16*b* having a diameter sufficiently greater than that of the post 14 to permit positioning of the retainer 10*a* over the post 14 into position so that a tab 18 clips over the wire rope 12 thereby securing it snugly against the post 14. The wire rope 12 is held against the post 14 within a cut-away or notch 20 within the post 14. Preferably, the retainer 10*a* is a plastics material, more preferably Nylon or High-Density Polyethylene (HDPE) although it may be appreciated that the retainer may be formed of any other suitable material including metal.

Within the embodiment shown in FIG. 1 the arms 16*a*, 16*b* are substantially 'C' shaped such as to clip about part of the circumference of the post. The arm may therefore be in the form of a split-ring 22. In this case, the arms 11*a*, 11*b* can be flexible enough to permit attachment of the retainer from the side of the post.

Figure 2:
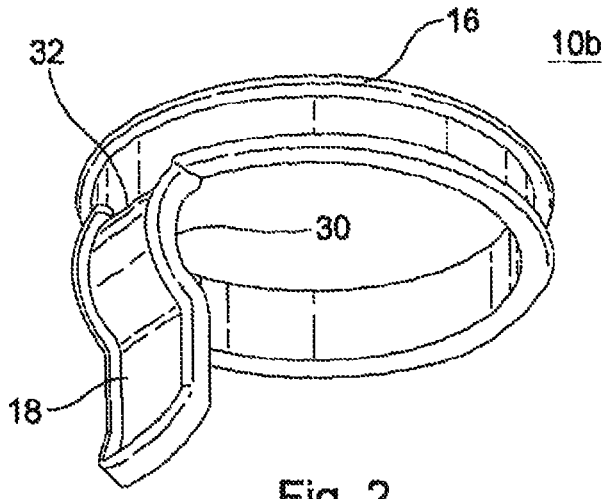
FIG. 2 is a schematic of a retainer according to an alternative embodiment of the present invention.

In an alternative embodiment, the retainer 10*b* is an annulus or ring as shown in FIG. 2 and therefore the retainer arms 16*a*, 16*b* may be considered to be a continuous sleeve 16.

Figure 3:
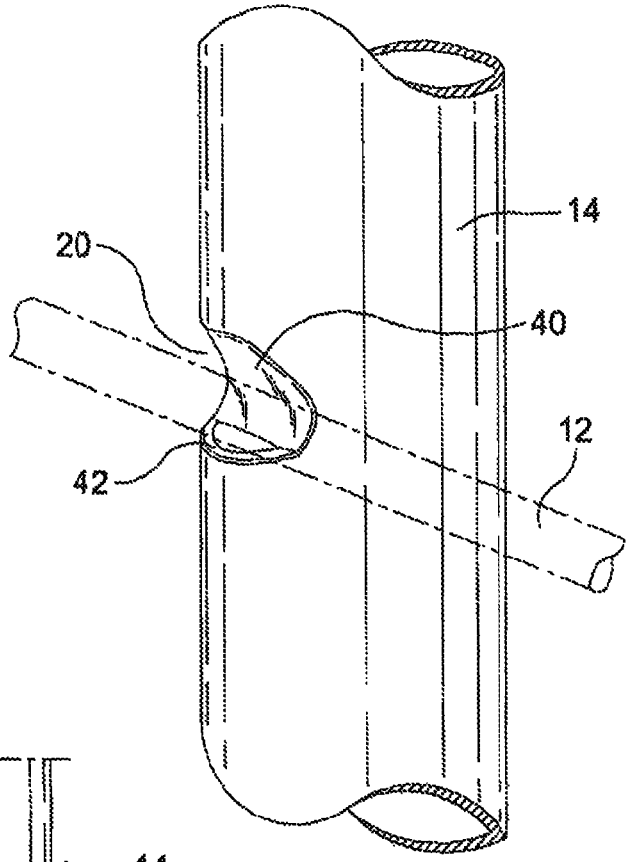
FIG. 3 shows a post according to yet another aspect with a notch for holding a wire rope.

Common to all embodiments of the invention, the retainer 10*a*, 10*b*, 10*c* comprises a clip or tab 18 that secures the wire rope 12 against the post 14. The tab 18 extends perpendicularly from the plane of the arm or sleeve 16 and has an arcuate portion 30 for holding the wire rope 12 in place against a post 14. In order to maximise the friction between the wire rope 12 and the tab 18, the arcuate portion 30 is shaped to correspond to the curvature of the wire rope 12. Additionally, in order to maximise the surface area of the wire rope 12 in contact with the post 14, the arcuate portion 30 holds the rope 12 against the post 14 within a notch or cut-away 20 (FIG. 3). This provides a 'snug-fit' between the rope 12 and the post 14 and acts to minimise the pull on the ropes through the slots during impact by a vehicle against the post 14.

The tab 18 of the retainer 10*a*, 10*b*, 10*c* is intended to be frangible or yieldable (for example at point 32) when subjected to a predetermined force. The point 32 and force at which the tab 18 yields or breaks is tailored to provide the required trade-off between holding the wire rope 12 snugly against the post 14 and releasing the wire rope 12 upon impact with a vehicle, the effect of which will be explained in detail below.

FIG. 3 shows a section of a post 14 in greater detail, with the wire rope 12 shown in phantom to allow the surface of the post 14 to be seen beneath the wire rope 12. As may be seen, the post 14 holds the wire rope 12 within a notch or cutaway 20 portion of the post. The notch 20 is recessed within an outer surface of the post 14 and is preferably formed by making a single cut into the post 14 and pressing the surface of the post inwards to form a curved portion or indentation 40 and a substantially flat portion or base 42.

Figure 4:
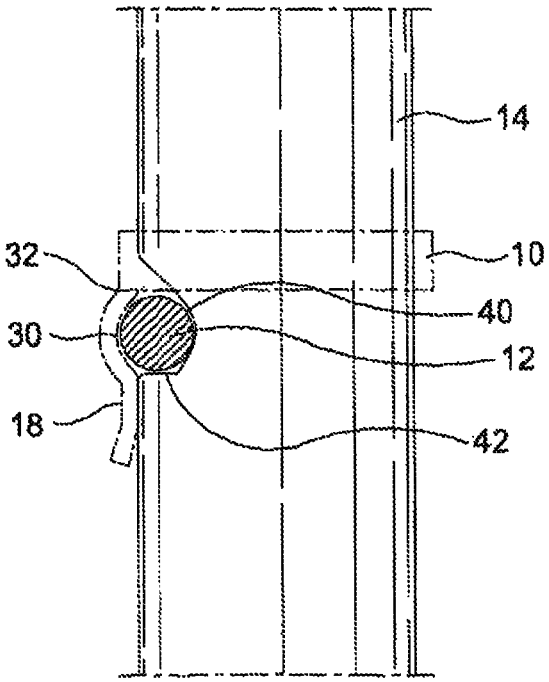
FIG. 4 shows a side view of the post of FIG. 3 wherein the wire rope is retained by a retainer according to an embodiment of the present invention.

FIG. 4 shows a cross-sectional view of the post 14 and wire rope 12, with the retainer 10*a*, 10*b*, 10*c* shown in phantom. The arrangement of the wire rope 12 in relation to the retainer tab 18 and the post notch 20 is detailed. The wire rope 12 is held snugly due to its position against the base 42 and indented surface 40 of the post 14 and the arcuate surface 30 of the retainer 10*a*, 10*b*, 10*c*.

In use, the wire rope 12 sits on the base 42 created by the cut into the post 14. The base 42 prevents the wire rope 12 from falling downwardly towards the ground either in-situ, during impact with a vehicle, or in some instances after impact with a vehicle. During impact, the wire rope 12 will therefore preferentially move upwards riding along the indentation 40 and against the tab 18 of the retainer 10*a*, 10*b*, 10*c*.

The additional advantages of providing an indentation 40 rather than a complete cutaway is that the wire rope 12 is held against the indented surface 40 which maximise the surface area and therefore the friction between the wire rope 12 and the post 14.

Figure 5:
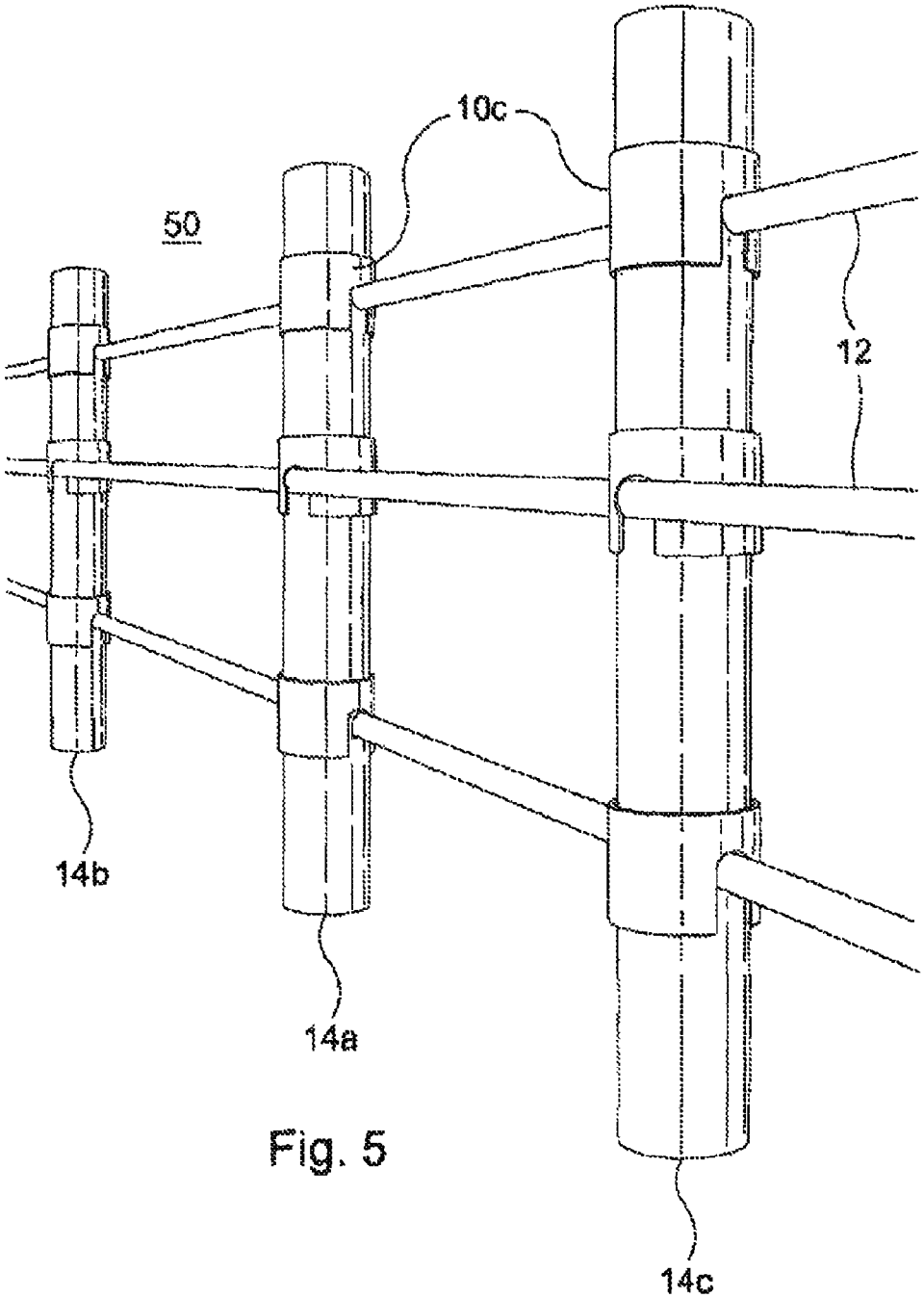
FIG. 5 shows a road safety barrier comprising a series of wire ropes and posts with an alternative arrangement of retainers.

FIG. 5 shows a series of wire ropes 12 held taught against a number of posts 14*a-c* by a plurality of retainers 10*c* to form a road safety barrier 50. FIG. 5 shows a further alternative retainer 10*c*, where the arm or sleeve 16 of the retainers 10*c* extends along the length of the post 14 a greater distance than the embodiments shown in FIGS. 1 and 2. The arrangement between the retainers 10*a*, 10*b*, 10*c*, wire ropes 12 and posts 14 are common to all embodiments. It may be appreciated that the number of wire ropes 12 and posts 14 may be chosen to provide the required strength of road safety barrier 50. In addition, although shown with each wire rope 12 positioned on a single side of the posts 14*b* and 14*c* (and on opposing side of post 14*a*), the wire ropes 12 may be sinuously woven between the posts 14, or the wire ropes 12 may be provided in parallel on the sides of the post 14.

As highlighted above, during assembly of the road safety barrier 50, the wire ropes 12 may be held in position against the posts 14 by the notches 20 within the posts. The retainer 10*a*, 10*b*, 10*c* may then be either slid over the post 14, clipped around the post or fastened with using conventional nail or screw fixings. The wire ropes 12 may then be tightened to the correct tension.

During an impact between the road safety barrier 50 and a vehicle in the region of post 14*a*, the post 14*a* begins to bend due to the impact of the vehicle. As the post 14*a* bends, the wire ropes 12 are tightened further due to an increase in the distance between the post 14*a* and its neighbouring posts 14*b*, 14*c* and the snug fit between the wire ropes 12 and the post 14 due to the retainers 10*a*, 10*b*, 10*c*. This tightening of the wire ropes exerts a lateral force by the ropes against the tab 18 of the retainer 10*a*, 10*b*, 10*c*. The wire ropes 12 act to dissipate the energy of the vehicle impact away from the impact point of post 14*a* and distribute the energy to the other posts 14*b*, 14*c*, and further posts (not shown) along the road safety barrier 50. However, the posts 14 are only able to assist in the energy dissipation of the impact if the wire ropes 12 are held in place against the post 14. This is achieved by the retainers 10*a*, 10*b*, 10*c* that prevent the wire ropes 12 from being displaced from the posts 14 during the shockwave or whip induced within the wire rope 12 by the initial impact of a vehicle. This has the added effect of minimising or managing the impact zone created along the length of the road barrier 50 during an impact. By minimising this impact zone, the efficiency of the road barrier is improved and the structural integrity of neighbouring sections of the road barrier is maintained.

The direction of this lateral force of the wire ropes 12 is a result of the base 42 preventing the wire ropes 12 from moving downwards towards the ground, and the indentation surface 40 of the cut-away 20 that channels upward movement of the wire ropes 12 towards the frangible or yieldable break point 32 of the retainer tab 18. As the yield stress of the tab 18 is reached, the tab 18 breaks (nominally at point 32), releasing the wire rope 12 from engagement with the post 14. The yield stress of the tab 18 is selected along with the snugness of fit between the wire rope 12 and the posts 14. If the yield stress of the tab 18 is too low, or the fit of the wire ropes 12 against the posts 14 is too loose, the ropes will tend to be released too early or will be ineffective at reducing the impact zone of the force from the impact. The impact force and whip will travel further down the line of the fence because the separation of the rope from the posts render the latter incapable of absorbing impact energy. Conversely, if the yield stress of the tab 18 is set too high, or the ropes are held too tightly against the posts, the wire ropes 12 will not be released from the posts.

The release of the wire ropes 12 from the posts 14 is necessary to minimise the impact zone and the extent of the road safety barrier 50 affected by an impact, or more pertinently, to ensure that the road safety barrier 50 provides a degree of give or movement during impact and does not act as a solid immoveable object. The primary advantage of this embodiment is that the release of the wire rope 12 from the post 14 is not instantaneous upon impact—rather the wire ropes 12 are held against the posts 14 for long enough to prevent the initial shockwave of the impact that travels along the wire ropes 12 (the 'whip' of the rope) from causing the wire ropes 12 to separate from a large number of posts 14 away of the impact point. As mentioned above, if the wire ropes 12 are separated from the posts 14*b*, 14*c*, this prevents those posts 14*b*, 14*c* without wire ropes 12 from absorbing the force of the impact and reduces the effectiveness of the road safety barrier 50. Instead, the engagement between the wire ropes 12 and the posts 14 by the retainer 10*a*, 10*b*, 10*c* holds the wire ropes 12 against the posts 14, distributing the energy of the impact at post 14*a* to neighbouring posts 14*b*, 14*c*. The wire ropes of these posts 14*b*, 14*c* are only released (via the frangible/yieldable tab 18) when the lateral force exceeds a predetermined amount and some of the energy from the impact has been absorbed by the posts 14*b*, 14*c*.

The invention claimed is:

1. A wire rope road safety barrier comprising:

at least one wire rope;

a plurality of posts configured to be supported in the ground along a roadside or central reservation, said posts comprising a cut-out provided in respective ones of the posts for supporting the at least one wire rope, wherein the cut-out is recessed within an outer periphery of the post and has a substantially flat portion that extends transversely to the longitudinal axis of the post and a curved portion extending from a part of the flat portion that is innermost relative to the outer periphery of the post to the outer periphery, wherein the substantially flat portion resists downward movement of the rope during vehicle impact whereas the curved portion permits upward movement thereof; and a retainer comprising:

an arm defining a plane, the arm for embracing at least half of a circumference of the post whereby the retainer can be held on the post at a position along its length, and a tab extending perpendicularly from the plane of the arm for retaining the at least one wire rope against the post, the tab being configured to yield at a break point at which the tab is attached to the arm when subjected to a lateral force by the at least one wire rope that exceeds a predetermined amount to permit separation of the rope from the barrier within a predetermined impact zone, wherein the at least one wire rope is retained captive within the cut-out by the retainer.

2. The wire rope road safety barrier according to claim 1, wherein the arm is in the form of a ring.

3. The wire rope road safety barrier according to claim 1, wherein the tab comprises an arcuate portion for retaining the at least one wire rope within the cut out and pressing the at least one wire rope against the post.

4. The wire rope road safety barrier according to claim 3, wherein the arcuate portion has a curved profile corresponding to the curvature of the at least one wire rope.

5. The wire rope road safety barrier according to claim 3, wherein the arm is in the form of a ring.

6. The wire rope road safety barrier according to claim 3, wherein the arcuate portion includes a first end attached to the arm at the break point.

7. The wire rope road safety barrier according to claim 3, wherein the arcuate portion includes a second end, wherein the tab includes a region having a planar face, the region attached to the second end of the arcuate portion, and wherein the tab is configured to allow the planar face to press against the outer periphery of the post with the at least one wire rope pressed against the post within the cut-out.

8. The wire rope road safety barrier according to claim 7, wherein the tab has a maximum width, wherein the arcuate portion has a first length and the region has a second length, wherein the tab has a minimum length defined by the first length plus the second length, and wherein the minimum length is greater than the maximum width.

9. The wire rope road safety barrier according to claim 1, wherein the arm is in the form of a split ring that can be positioned on the post from a direction transverse to a longitudinal axis of the post.

10. The wire rope road safety barrier according to claim 1, wherein said predetermined amount is inversely proportional to a lateral extent along a line of the road safety barrier of an impact zone that is subject to a deflection of the at least one wire rope.

11. The wire rope road safety barrier according to claim 1, wherein the tab is configured to press the at least one wire rope against the post.

12. The wire rope road safety barrier according to claim 1, wherein the depth of each cut-out is less than that of the at least one wire rope.

13. The wire rope road safety barrier according to claim 1, wherein the at least one wire rope extends between the posts and is held in tension along the length of the barrier.

14. The wire rope road safety barrier according to claim 1, wherein the arm comprises an upper edge and a lower edge, the tab extending from the lower edge.

15. The wire rope safety barrier according to claim 1, wherein the tab is configured to frangibly break at the break point at which the tab is attached to the arm when subjected to the lateral force by the at least one wire rope that exceeds the predetermined amount to permit separation of the rope from the barrier within a predetermined impact zone.

16. A wire rope road safety barrier comprising:

at least one wire rope;

a plurality of posts configured to be supported in the ground along a roadside or central reservation, said posts comprising a cut-out provided in respective ones of the posts for supporting the at least one wire rope, wherein the cut-out is recessed within an outer periphery of the post and has a substantially flat portion that extends transversely to the longitudinal axis of the post and a curved portion extending from a part of the flat portion that is innermost relative to the outer periphery of the post to the outer periphery, wherein the substantially flat portion resists downward movement of the rope during vehicle impact whereas the curved portion permits upward movement thereof and wherein the depth of each cut-out is less than that of the at least one wire rope; and a retainer comprising:

an arm defining a plane, the arm for embracing at least half of a circumference of the post whereby the retainer can be held on the post at a position along its length, the arm, and a tab extending perpendicularly from the plane of the arm for retaining the at least one wire rope against the post, the tab being configured to yield at a break point at which the tab is attached to the arm when subjected to a lateral force by the at least one wire rope that exceeds a predetermined amount to permit separation of the rope from the barrier within a predetermined impact zone, wherein the tab comprises an arcuate portion for retaining the at least one wire rope within the cut out and pressing the at least one wire rope against the post.

* * * * *